US009290040B2

(12) United States Patent
Verhaeghe

(10) Patent No.: US 9,290,040 B2
(45) Date of Patent: Mar. 22, 2016

(54) METHODS FOR MANUFACTURING PANELS AND PANEL

(75) Inventor: Bart Verhaeghe, Dranouter (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 404 days.

(21) Appl. No.: 12/602,344

(22) PCT Filed: Jul. 15, 2008

(86) PCT No.: PCT/IB2008/001844

§ 371 (c)(1),
(2), (4) Date: Nov. 30, 2009

(87) PCT Pub. No.: WO2009/013580

PCT Pub. Date: Jan. 29, 2009

(65) Prior Publication Data

US 2010/0192793 A1 Aug. 5, 2010

(30) Foreign Application Priority Data

Jul. 26, 2007 (BE) ..... 2007/0366

(51) Int. Cl.

| | |
|---|---|
| ***B41M 1/38*** | (2006.01) |
| ***B44C 1/24*** | (2006.01) |
| ***B44C 5/04*** | (2006.01) |

(52) U.S. Cl.

CPC ..... *B44C 5/0469* (2013.01); *B44C 1/24* (2013.01); *B41M 1/38* (2013.01)

(58) Field of Classification Search

CPC ..... B41M 7/00; B41M 1/38; B44C 5/04; B44C 1/24; B44C 3/025; B44C 5/043; B44C 5/0469

USPC ..... 101/32, 22, 23, 492

See application file for complete search history.

(56) References Cited

U.S. PATENT DOCUMENTS

| | | | | |
|---|---|---|---|---|
| 3,173,804 | A | 3/1965 | Standfuss | |
| 3,385,993 | A * | 5/1968 | Kimball | 313/271 |
| RE33,599 | E * | 5/1991 | Courtoy et al. | 428/141 |
| 6,565,919 | B1 * | 5/2003 | Hansson et al. | 427/203 |
| 6,908,585 | B2 * | 6/2005 | Wright et al. | 264/447 |
| 6,991,830 | B1 | 1/2006 | Hansson et al. | |
| 7,003,364 | B1 * | 2/2006 | Hansson et al. | 700/98 |
| 7,090,910 | B2 * | 8/2006 | Courtoy et al. | 428/158 |
| 2003/0020767 | A1 * | 1/2003 | Saksa | 347/2 |
| 2003/0138617 | A1 * | 7/2003 | Courtoy et al. | 428/304.4 |
| 2006/0144004 | A1 | 7/2006 | Nollet et al. | |
| 2006/0156672 | A1 * | 7/2006 | Laurent et al. | 52/589.1 |

FOREIGN PATENT DOCUMENTS

| | | | |
|---|---|---|---|
| DE | 2721292 | A1 | 11/1978 |
| DE | 4421559 | A1 | 12/1995 |
| EP | 0031316 | A1 | 7/1981 |
| EP | 1419902 | A1 | 5/2004 |

(Continued)

*Primary Examiner* — Matthew G Marini
*Assistant Examiner* — Leo T Hinze
(74) *Attorney, Agent, or Firm* — Capitol City TechLaw

(57) ABSTRACT

A method for manufacturing panels of the type having at least a substrate and a printed decor with a relief provided on the substrate involves printing, whether or not by the intermediary of primer layers, at least a portion of the decor onto the substrate and forming the relief. The relief is formed at least partially after the portion of the decor has been printed on the substrate.

8 Claims, 3 Drawing Sheets

(56) References Cited

FOREIGN PATENT DOCUMENTS

| | | | |
|---|---|---|---|
| EP | 1717030 | A2 | 11/2006 |
| GB | 1108549 | A | 4/1968 |
| GB | 1510810 | A | 5/1978 |
| GB | 2324982 | A | 11/1998 |
| WO | 97/47834 | A1 | 12/1997 |
| WO | 01/48333 | A1 | 7/2001 |
| WO | 01/96688 | A1 | 12/2001 |
| WO | 01/96689 | A1 | 12/2001 |
| WO | 2004/042168 | A1 | 5/2004 |
| WO | 2004/042188 | A2 | 5/2004 |
| WO | 2004/108436 | A2 | 12/2004 |
| WO | 2005/116361 | A1 | 12/2005 |
| WO | 2006/002917 | A2 | 1/2006 |
| WO | 2006/063803 | A2 | 6/2006 |
| WO | 2006/066776 | A2 | 6/2006 |
| WO | 2007/072198 | A2 | 6/2007 |

* cited by examiner

METHODS FOR MANUFACTURING PANELS AND PANEL

BACKGROUND OF THE INVENTION

1. Field of the Invention

This invention relates to methods for manufacturing panels, as well as to panels which are obtained or can be obtained by means of such method.

More particularly, the invention relates to a method for manufacturing panels of the type comprising at least a substrate and a decor provided on this substrate. In particular, the invention relates to a method that involves printing at least a portion of the decor onto the substrate, whether or not by the intermediary of primer layers.

2. Related Art

As an alternative for the traditional laminated panels, wherein a pre-printed paper sheet is provided, for example, glued or pressed, on a substrate, and wherein the print of the paper sheet forms the decor of the panel concerned, panels, wherein a decor, whether or not directly, is printed on the substrate already are known, for example, from the patent documents U.S. Pat. No. 3,173,804, GB 2 324 982, WO 01/48333, WO 2004/042168, WO 2005/116361, WO 2006/002917 and EP 1 717 030.

Generally, a difference can be made between two techniques by which a decor can be printed on a substrate. On the one hand, as in U.S. Pat. No. 3,173,804, an analogous printing technique can be applied, such as offset printing, wherein a print is formed on a roll, for example, a rubber roll, and this print is transferred via the roll on the substrate, whether or not by means of primer layers, and on the other hand, as in WO 01/48333, a digital printing technique can be applied, such as a technique wherein printing heads form the print directly on the substrate, whether or not by the intermediary of primer layers. In this last case, use can be made, for example, of one or more inkjet printers.

Where in the traditional laminated panels mostly use is made of a transparent or translucent paper sheet extra provided with resin, such as an overlay, for protecting the decor against wear and/or scratches, in the aforementioned alternative panels mostly a wear-resistant layer of lacquer is provided on the printed decor. By means of a decor printed on the substrate and such wear-resistant layer of lacquer mostly more lively and/or color-proof decors are obtained in comparison with laminated panels, as the applied lacquer layer mostly has a better transparency than the protective top layers used in laminated panels.

Said wear-resistant lacquer selectively may render a glossy or matte effect, however, mostly keeps forming a flat top layer on the panel. The possibilities known from the state of the art for remedying this and forming in this lacquer layer impressions or other relief forms for imitating, for example, a wood structure or stone structure, up to now do not yet achieve the realism which at present in fact can be achieved in laminated panels. For examples of structures in laminated panels, reference is made to the patent documents WO 01/96688, WO 01/96689, WO 2006/063803, WO 2006/066776, US 2006/0144004 and WO 2007/072198.

A first prior art possibility for forming relief at the surface of a panel with a decor printed on the substrate consists of forming recesses in said wear-resistant lacquer layer. This can be performed, for example, by forming impressions in this layer by means of a press element or by the local application of chemicals dislodging the lacquer layer, as it is the case, for example, in U.S. Pat. No. 6,991,830. The known structures provided by means of this first possibility are limited in depth, as they, according to the state of the art, remain limited in the lacquer layer. Forming deep impressions directly in the lacquer layer holds certain risks. With large deformations, it is possible that the lacquer layer breaks or is interrupted.

A second prior art possibility for forming structure at the surface of a panel with a decor printed on the substrate is described, for example, in said WO 2004/042188. According to this second possibility, for example, the substrate can be provided with a structure or relief before the print is performed. The obtained structure remains present after printing the substrate and after providing the wear-resistant lacquer layer. Such technique allows obtaining deeper structures or deeper relief than this is the case with said first possibility. Introducing level differences on the substrate still to be printed, however, leads to increased complexity when performing the printing process. Thus, for example, it is possible that in case of digital printing, the focus distance and/or the position of the printer must be adjusted according to the structure of the substrate to be printed. In the case of offset print, it is possible that the roll providing the print on the substrate is not sufficiently flexible to follow the provided structure, with as a possible consequence the occurrence of undesired unprinted portions.

SUMMARY OF THE INVENTION

The present invention aims at alternative methods for manufacturing panels with a decor printed on the substrate, wherein these panels have a structure or relief at their surface. According to various aspects and preferred embodiments of the invention, herein one or more of the aforementioned disadvantages of the state of the art may be overcome.

To this aim, the invention according to its first aspect relates to a method for manufacturing panels of the type having at least a substrate and a printed decor with a relief provided on this substrate, wherein the method at least involves printing, whether or not by the intermediary of primer layers, at least a portion of the decor onto the substrate and forming said relief, with the characteristic that said relief is formed at least partially after said portion of the decor already has been printed on the substrate. It is clear that in the panels of the present invention, the printed decor itself has a relief and that this relief thus is not limited exclusively to the possible layers located on top, as it is the case in said first possibility from the state of the art. Preferably, said portion of the relief is formed at least in the surface of the substrate on which the already provided portion of the printed decor is situated. Still better, the decor is printed for the major part, if not entirely, before said relief is provided.

Preferably, for providing the respective portion of the printed decor, one starts from a substrate with a flat surface. This means a surface to be printed which is free of local recesses, such that preferably this surface is free of local height differences which are larger than 0.3 millimeters and still better this surface is free of local height differences which are larger than 0.1 millimeter. Such flat substrate leads to a less complex printing process, which still can accomplish a print with an almost complete covering and with a good resolution on the substrate. It is clear that according to the invention it is not excluded that one starts from a substrate in fact already having a certain structure, wherein this structure then either is or is not provided on purpose.

In that at least a portion of said recesses are provided in the surface after said portion of the decor already is printed on the substrate, the respective portion of the decor can be provided on a substantially flat substrate, the latter already being or not being provided with primer layers preferably also extending substantially flat on the substrate. In comparison with said first possibility for providing a structure, the method of the invention offers the possibility of forming deeper impressions, wherein, as mentioned, preferably at least the already printed portion of the decor is provided with a relief, and in comparison with said second possibility offers the advantage that the complexity of the printing process can be restricted in that one may possibly work on a flat underlying surface.

It is clear that according to the invention, it is not excluded to provide another than said portion of the printed decor on the substrate after said relief, or a portion thereof, already has been accomplished. Also, it is not excluded that the already obtained portion of this relief afterwards also is provided with a print or is provided with a decor in any other manner. For example, a coloration by means of a color or lacquer can be applied, for example, by means of a technique similar to the one described in WO 2004/108436.

It is noted that it is not excluded that for realizing the printed decor, apart from applying a printing technique performed on the substrate, also other techniques can be applied in combination therewith, such as applying a pre-printed paper sheet or applying transfer printing.

Preferably, for printing the decor use is made of a digital printing technique, for example, by means of one or more inkjet printers, wherein the decor preferably is formed directly on the substrate or on a possible primer layer. Of course, it is not excluded that the digital printing technique is applied for forming the respective portion of the decor on a medium, such as a roll or rubber roll, and transferring it afterwards onto the substrate by means of this medium. When applying a digital technique, preferably four-color printing is used, wherein the colors cyan, magenta, yellow and black can be applied. Of course, it is not excluded to work with the colors red, green, blue and possibly black. Other colors are not excluded, either. With such digital technique, UV inks can be applied. The inks applied can be water-based as well as solvent-based.

It is clear that for printing the decor, use can also be made of an analogous printing technique, such as screen printing, pad printing or offset printing. Preferably, for example, in the case of offset printing, use is made of structured, for example, engraved or etched, printing rolls which first form the print on a medium, and wherein this medium provides the print formed thereon on the substrate. For example, the printing roll can rotate against a roll with a flexible surface, such as a rubber roll or soft rubber roll, and print it in this manner, after which the flexible roll can transfer the print onto the substrate, whether or not provided with any primer layers. It is noted that in the case of an analogous printing technique, preferably also a plurality of printing devices providing different colors are used. For example, in the case of offset printing, three, four or more different colors can be used successively. Possibly, four-color printing may also be applied. Another possibility is mixing the colorants already according to the major colors occurring in the desired pattern to be printed and successively providing these colors.

Preferably, said relief is formed by means of impressions, for example, obtained by means of a press element, such as a press plate, a press belt or a roll. Preferably, said relief is only formed when the respective portion of the decor has already dried at least partially and preferably entirely. This drying may take place, for example, in a forced manner by means of hot air and/or radiation, for example, UV radiation. Other possibilities for forming the relief relate to removing material, for example, by means of a machining treatment, such as milling or laser treatment.

It is noted that the decor can show any pattern or even can be made without a pattern, either with a uniform color or with random tints. Preferably, the method is applied for manufacturing panels, wherein said decor thereof, or at least the respective portion thereof, represents a wood pattern and/or a stone pattern.

Preferably, said relief at least partially corresponds to the printed decor. This means that the relief is made with recesses and/or protrusions at the locations where the decor shows a corresponding image, and/or that said recesses and/or protrusions follow characteristics depicted in the decor. For example, in the case of a decor representing at least a wood pattern, recesses and/or protrusions can be formed which correspond to wood nerves, wood pores and/or wood flowers depicted in the wood decor, and/or recesses and/or protrusions can be formed which globally follow the wood nerves, wood pores and/or wood flowers depicted in the decor. In the case of a decor representing at least a stone pattern, the recesses and/or protrusions can correspond to or coincide with the veins depicted in the pattern and/or with the stone flakes depicted there, as it may be the case when imitating slate or other scaling stone species.

Other possibilities for a relief, whether or not corresponding to the decor, is a relief composed of recesses and/or protrusions intended for accomplishing mutual level differences between structurally independent decor sections or level differences in one and the same decor section.

Examples of the first are recesses or protrusions which correspond to the decor sections depicted in the decor, which lead to an individualized global level of the individual decor sections, wherein preferably a difference in height exists between one or more adjacent decor sections. Instead of a height difference or in combination therewith, one may also apply an individualized relief showing, according to the decor section, another inclination degree and/or curvature.

Examples of the latter are imitations of damages due to mechanical or chemical wear, wherein the mechanical wear, for example, can be a hollowing out of the panels obtained by frequent walking on the floor. Also, by recesses and/or protrusions, imitations of mechanical treatments performed on the surface of the panel may be obtained, such as scraping treatments, or imitations of the result of influences due to climatologic circumstances or to parasites. Other examples are recesses which are intended as an imitation of chamfers, gaps, imitation chamfers or imitation gaps. It is clear that by means of the method of the present invention, any relief can be formed. In particular, similar structures can be achieved, such as those known with the laminate panels from the already mentioned documents WO 01/96688, WO 01/96689, WO 2006/063803, WO 2006/066776, US 2006/0144004 and WO 2007/072198. In case the print relates to a wood pattern, it is possible to imitate the damage to this wood by a parasite such as woodworm in a convincing manner, and it is also possible to imitate paint coming off in flakes.

According to a preferred embodiment, said relief comprises at least height differences which are larger than the thickness of the printed decor. Such large height differences or deep recesses and/or high protrusions enhance the realism of the finally obtained panel, as they also can impart a depth effect to the decor. Such relief remains better visible after applying a possible protective layer, such as a layer of lacquer. Still better, said relief of the printed decor is made with such height differences that it continues at least to beneath the initial global level of the printed decor. It is clear that such relief maximizes the above-mentioned advantages. It is possible that said relief is made with such height differences that it continues into the substrate, or at least continues into a layer located between said printed decor and the actual substrate.

As already mentioned, the method of the invention can be applied for manufacturing panels of which the top layer provided on the substrate comprises a wear-resistant layer, wherein preferably said wear-resistant layer is provided above said printed decor after said printed decor already has been provided with said relief. Preferably, the wear-resistant layer consists at least of a lacquer, such as a lacquer curing by means of UV or electron beam. Such wear-resistant layer may comprise hard mineral or ceramic particles, such as aluminum oxide, silicon carbide, titanium oxide and the like. The hard particles comprised in the wear-resistant layer may have grain sizes ranging from 20 nanometers to 200 micrometers. For examples of possible wear-resistant lacquers, reference is made to the already above-mentioned WO 01/48333, where, amongst others, the use of acryl lacquers, epoxy lacquers and maleimide lacquers is mentioned. For further examples of wear-resistant layers, reference is also made to WO 2005/116361. It is clear that such protective layer as such possibly can be composed of multiple layers, which possibly may comprise mutually differing materials, may have a mutually differing composition of the same or other materials and/or may have mutually differing material characteristics. Further, it is clear that as a protective layer, also a material sheet provided with synthetic material, such as a so-called overlay, can be applied.

According to still another preferred embodiment of the method of the invention, the relief of the printed decor obtained according to the invention is combined with a relief which is formed as such in the protective layer, for example, in a lacquer layer or overlay, and which then preferably is realized by means of the first possibility discussed in the prior art. According to the invention, it is also not excluded that the relief of the printed decor is formed simultaneously and possibly by means of the same treatment with the relief of the protective layer. Preferably, in this possibility a so-called overlay is used as a protective layer. As mentioned, with deep impressions there is an increased risk of breaking a possible lacquer layer as a protective layer. However, with this possibility applying a lacquer layer is not excluded, either. According to the invention, particular measures can be taken in order to limit the risk of breaking such lacquer layer also when applying deep impressions. This can be achieved, for example, by completely curing or drying the lacquer layer only after said relief has been provided. Of course, curing may take place in part prior to forming the relief.

The method in which the printed decor is made with a relief, as well as the lacquer layer as such, can lead to new possibilities when manufacturing panels with a decor printed on the substrate. For example, by means of such method panels can be manufactured having recesses, the depth of which is larger than the thickness of the lacquer layer, in combination with finer recesses, the depth of which is smaller than the thickness of the lacquer layer. According to a second independent aspect, the present invention thus relates to a method for manufacturing panels of the type comprising at least a substrate and a top layer provided on this substrate, wherein said top layer comprises at least a printed decor and a synthetic layer located on this decor, as well as a structure of recesses and/or protrusions, wherein said printed decor is obtained at least by performing a print on the substrate, whether or not by the intermediary of primer layers, with the characteristic that said structure is realized at least in two successive steps, namely, on the one hand, a first step in which at least the substrate is provided with a structure, and, on the other hand, a second step in which at least said synthetic layer is provided with a structure. More particularly, the majority of the structure in the surface of the substrate is realized during said first step, whereas in the second step substantially only recesses are realized which are located exclusively in the synthetic layer itself and as such do not continue into the substrate.

By performing two separate treatment steps, the method of the present invention allows manufacturing panels having complex resulting structures in the top layer. Preferably, these structures then substantially consist of the superposition of the structures provided with the separate steps. Preferably, said first step takes place before said synthetic layer is completely or partially provided, and preferably the second step takes place at the moment when said synthetic layer indeed is completely or partially provided. Another possibility is that the second step is performed simultaneously with the application of the synthetic layer.

According to a first preferred embodiment, for said first step a method is applied in which the substrate is at least partially provided with a structure after said portion of the decor already is printed on the substrate. Herein, for example, use can be made of a method with the characteristics of the first aspect.

According to a second preferred embodiment, for said first step a method is applied in which the substrate is at least partially provided with a structure prior to printing said portion of the decor on the substrate. According to this preferred embodiment, for said first step use can be made of the techniques described in WO 2004/042168.

As synthetic layer, for example, a lacquer layer can be applied, such as the lacquer layers discussed by means of the first aspect. Preferably, in such lacquer layer also wear-resistant particles, such as aluminum oxide particles, are provided.

For said second step preferably a method is applied in which the synthetic layer, which already has been applied completely or at least partially, is provided with a structure. Herein, for example, impressions can be performed in the already provided portion of the synthetic layer. Herein, the impressions may be realized by means of a roll, a press plate, a press belt or the like. As an alternative or in combination therewith, for said second step also a method can be applied in which the synthetic layer is provided entirely or partially selectively, for example, by depositing it by means of an inkjet system.

Preferably, when providing the substrate with a structure in said first step, recesses are formed in this substrate with a larger surface and/or a larger depth compared to the recesses formed when providing the synthetic layer with a structure during said second step. For example, larger recesses, such as recesses for imitating chamfers or wear, or recesses for imitating scraping treatments, can be formed in the first step, whereas smaller recesses, such as recesses for imitating wood pores, wood nerves, stone veins, or recesses and/or protrusions defining differences in gloss degree, can be formed in said second step. The larger depth and/or surface of the recesses formed in said first step is also of importance when said synthetic layer is provided after forming said recesses. Namely, some synthetic layers may accomplish a flattening effect, which can completely or partially neutralize the recesses or structures formed in the first step.

Preferably, providing with a structure in the first and/or second step is performed by forming impressions by means of a press element, such as a press roll, a press plate or a press belt.

The methods of the first and/or the second aspect of the present invention preferably are applied for manufacturing floor panels. It is clear that the invention also relates to a panel, for example, a floor panel, furniture panel, wall panel, ceiling panel, which is obtained by means of a method according to the invention. As a substrate for such panels preferably use is made of wood-based boards or panels. Preferably, for the substrate use is made of boards or panels which can be provided with a relatively smooth surface, as it is the case, for example, with MDF or HDF boards (Medium Density Fiberboard or High Density Fiberboard). It is not excluded that a pre-treatment of the boards has to be performed in order to obtain such smooth or flat surface.

As aforementioned, the substrates can be provided with one or more primer layers. For such possible primer layers and possible other pre-treatments, such as polishing treatments, of the board surface, reference is made to the already mentioned WO 2006/002917. Such pre-treatment possibly can comprise also softening or humidifying the board by means of heat, water or chemical agents, such as ammonia. Such softening of the board can promote forming the relief in the printed decor.

According to a third independent aspect, the present invention also relates to a panel of the type comprising at least a substrate and a top layer provided on this substrate, wherein said top layer comprises a structure of recesses and/or protrusions, a printed decor and a synthetic layer provided on this decor, wherein said decor is obtained at least by a print performed on the substrate, whether or not by the intermediary of primer layers, with the characteristic that said printed decor as such has a relief and that said structure of the top layer is at least composed of, on the one hand, said relief of the printed decor and, on the other hand, of recesses and/or protrusions which are formed in the top layer, however, are located at a distance above said printed decor. It is evident that such panel can be obtained by means of a method with the characteristics of the first and/or the second aspect. The particularity of the panels of the third aspect resides in the fact that the structure of the top layer is constructed of two superposed structures, whereby a multitude of design possibilities is obtained for such panels. Preferably, for the relief of the decor at least recesses and/or protrusions are used which have a larger depth and/or surface than it is the case with the recesses and/or protrusions formed in the top layer.

Preferably, said top layer above the decor is free of material sheets, for example, free of carrier sheets for resins, such as overlays. Preferably, the top layer above the decor substantially consists of a cured substance, such as a lacquer or a resin. As already explained in the introduction, the absence of material sheets is favorable for the color fastness of the print.

BRIEF DESCRIPTION OF THE DRAWINGS

With the intention of better showing the characteristics of the invention, hereafter, as an example without any limitative character, several preferred embodiments are described, with reference to the accompanying drawings, wherein:

DETAILED DESCRIPTION OF EXAMPLE, NON-LIMITING EMBODIMENTS

Figure 1:
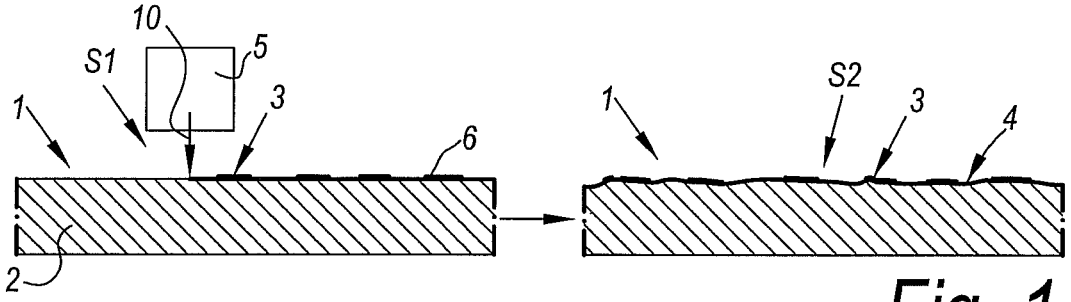
Figure 3:
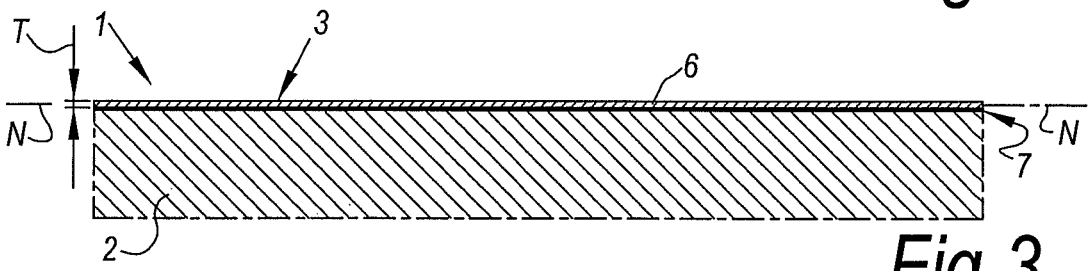
Figure 4:
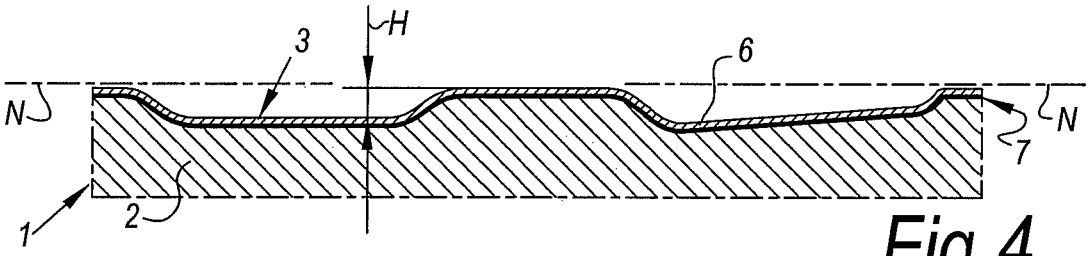
Figure 5:
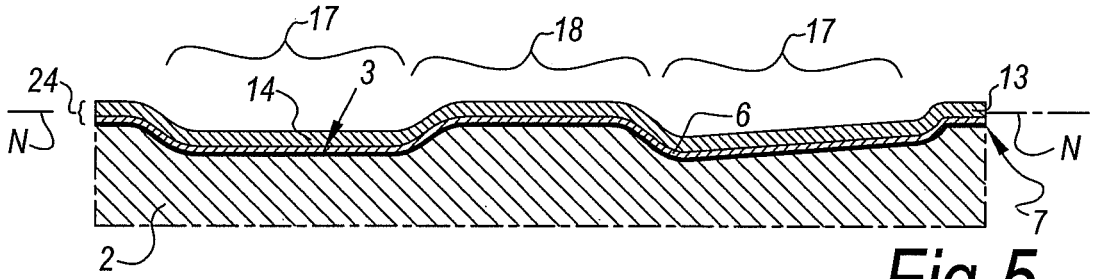
Figure 6:
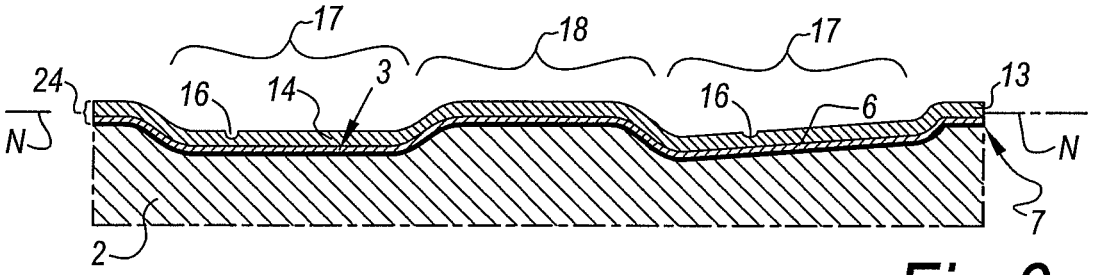
Figures 2, 7:
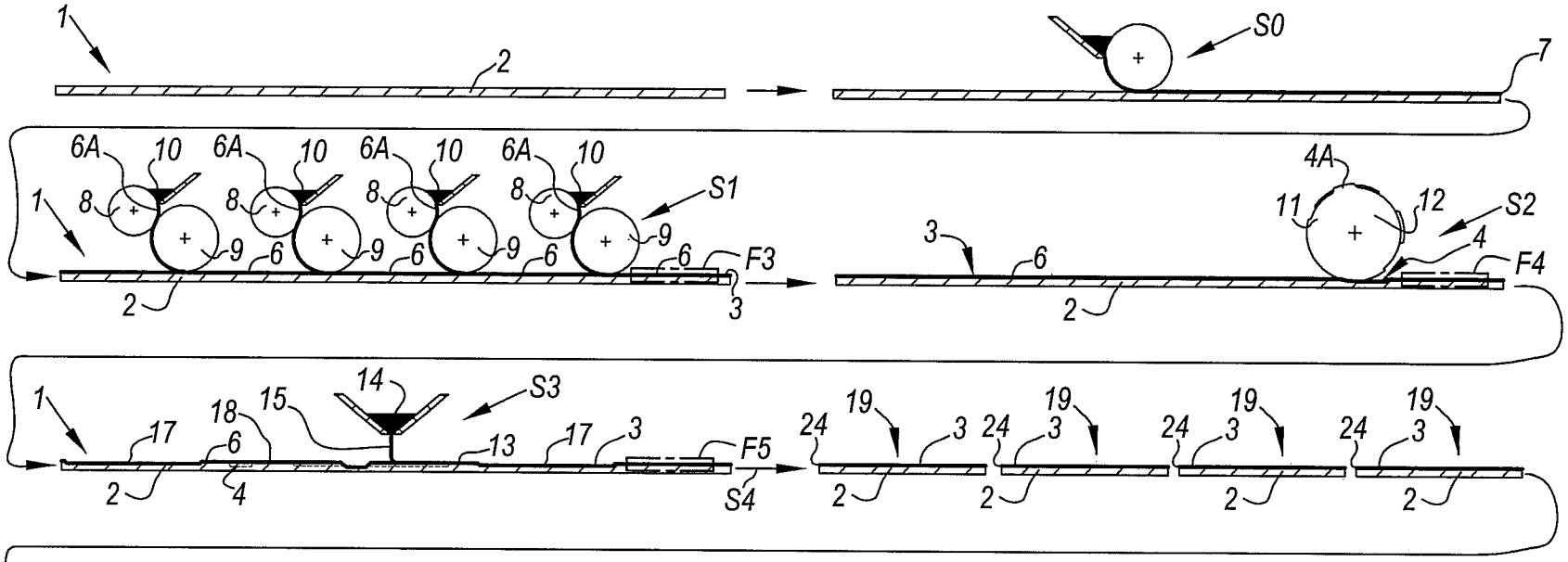
Figure 8:
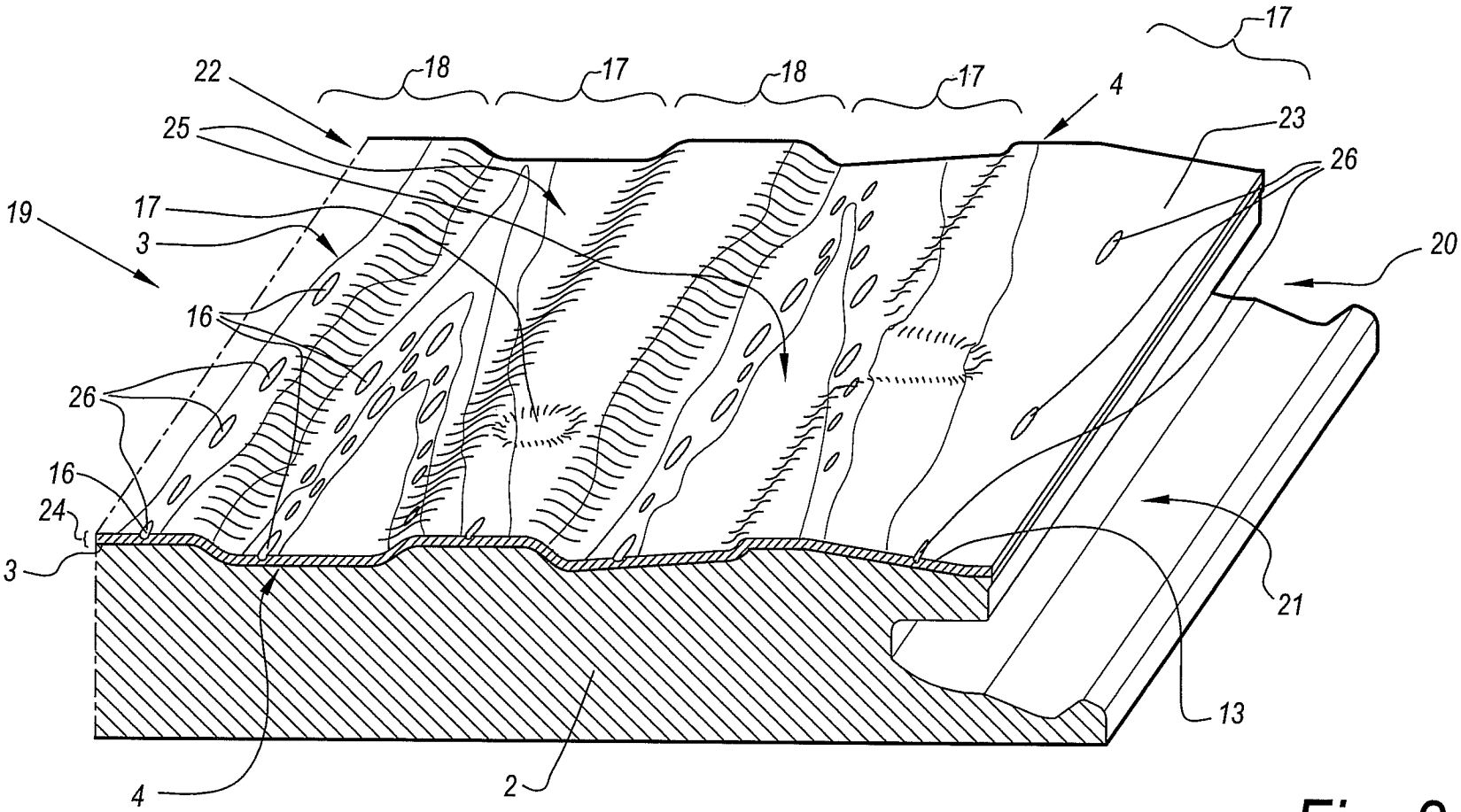

FIG. 1 schematically illustrates some steps of a method according to the present invention;

FIG. 2 schematically represents a preferred embodiment of the method represented in FIG. 1;

FIGS. 3 to 5, at a larger scale, represent a view on the areas indicated in FIG. 2 by F3, F4 and F5, respectively;

FIG. 6, in a view similar to that of FIG. 5, represents a variant;

FIG. 7 for a variant at a larger scale represents a view on the area indicated by F7 in FIG. 2; and FIG. 8, at a larger scale and in perspective, represents a view on the area indicated by F8 in FIG. 7.

FIG. 1 schematically shows the method of the present invention. Herein, a panel 1 is manufactured comprising a substrate 2 and a printed decor 3 with a relief 4 provided on this substrate 2.

In step S1 represented at the left hand side in FIG. 1, it is illustrated that the method consists at least of printing at least a portion of the decor 3 on the substrate 2. This can be performed by any printing device 5. In the example, the print 6 is performed on a substantially flat substrate 2 and, as represented in the step S2 illustrated at the right hand side in FIG. 1, thereafter the printed decor 3 is provided with a relief 4. Herein, it is clear in the example that the printed decor 3 itself is provided with a relief 4.

FIG. 2 shows a preferred embodiment of the method, wherein the substrate 2, for example, a MDF or HDF board, is provided with a primer layer 7 in a preceding step SO. This primer layer 7 may be, for example, white or can have a uniform color matching the colors of the pattern still to be printed. This primer layer 7 can be provided in any manner, for example, use can be made of rolls and/or of an application technique by means of one or more spatulas.

In the example of FIG. 2, the printing step S1 is performed by means of several, in this case four, successive offset prints, which each apply a print 6 of another color on the substrate 2, in this case, on the primer layer 7. The applied offset printing devices 5 substantially consist of two rolls 8-9, amongst which a first pressure roll 8 provided with a structure, on which the colorant 10 is provided, and a second, preferably a soft, flexible roll 9, for example, a rubber roll or a soft rubber roll, onto which the print 6A formed on the first roll 8 is transferred and by means of which this print 6A is provided on the substrate 2, in this case on the already provided primer layer 7 or primer layers. It is evident that according to a not-represented variant, also digital printing devices 5, such as inkjet printers, can be used. Preferably, then also multiple inkjet printers are used, which successively deposit different colors on the substrate 2 or on the primer layers 7.

FIG. 3 shows the result obtained after the first step S1. As represented, in this step preferably a flat print 6 is obtained forming the initial global level N of the printed decor 3.

In the example of FIG. 2, the step S2 of providing a relief 4 is performed by means of a roll 11 showing the structure or relief 4A to be impressed. This relief or this structure 4A may or may not correspond to the print 6 already provided on the substrate 2. It is evident that for providing the relief 4 also other techniques can be used or that these techniques may also be combined with the application of a roll 11. For example, one may also work with other press elements 12, such as with a flat press plate or with a press belt. It is also possible that, apart from pressure forces, also heat is applied for providing the relief 4 in the decor 3.

FIG. 4 shows the result of the step S2. Herein, it is clear that the print 6 itself has obtained a relief 4. In this case, the relief 4 obtained comprises height differences H which are larger than the thickness T of the printed decor 3. Here, the relief 4 is made with such height differences H that it continues at least to beneath the initial global level N of the printed decor 3 or the print 6, and in this case the relief 4 even continues up into the substrate 2. Of course, it is not excluded that certain portions of the printed decor 3 keep their initial level N.

FIG. 2 shows that the printed substrate 2, which also is provided with a relief 4, in a first additional step S3 also can be provided with a wear-resistant layer 13, for example, by providing a lacquer 14. The application of such lacquer 14 can take place in various manners, for example, by moving the board or the substrate 2 through a lacquer curtain 15, as represented here. Of course, according to the kind of lacquer 14 also a treatment for drying the lacquer 14 can be performed. This may relate here, for example, to drying with hot air, or drying by means of radiation, such as UV radiation or electron radiation.

FIG. 5 illustrates a result possibly obtained hereby. From this example, it is clear that the relief 4 provided in the decor 3 also can be observable after providing such lacquer layer 13 at the surface of the panel 1. It is clear that such lacquer 14 possibly can be provided with hard particles, which may enhance the wear resistance or scratch resistance of such panels 1.

FIG. 6 represents a variant in which the wear-resistant layer 13 as such also is provided with a structure, in this case in the form of recesses 16 occupying a smaller surface than the recesses 17 or impressions formed in the printed decor 3. Such interruption of the structure in large impressions, recesses 17 and/or protrusions 18, which are formed in the decor 3 and/or in the substrate 2, and small impressions, recesses 16 and/or protrusions, which are limited in the wear-resistant layer 13, as such can offer advantages, as mentioned in the introduction by means of, amongst others, the second and the third aspect.

It is noted that the steps represented in the FIGS. 2 through 6 also form an illustration of a method with the characteristics of the second aspect of the present invention, wherein FIG. 4 shows the result of a possible first step of such method and FIG. 6 shows the result of a possible embodiment for the second step mentioned there. FIG. 6 also clearly shows that the relief formed as such in the synthetic layer 13 comprises recesses 16, which are situated at a distance above the printed decor 3. Further, it is noted that the panel 1 obtained also forms an example of the third aspect of the present invention.

Further possible steps of a method according to the invention are also illustrated in FIG. 2 and comprise, for example, a step S4 in which the panels 1 are divided into smaller units 19, and/or a step S5 in which the panels 1 or the smaller units 19 obtained are finished at their edge 20, for example, by providing coupling means 21 at these edges 20, with which coupling means two of such panels 1 can be interconnected. Other possibilities, not shown here, for finishing the edges 20 of panels 1-19 are, for example, applying a decorative coating on these edges 20. It is noted that the obtained panels 1 or smaller units 19 can have any shape. Preferably, this relates to rectangular and/or square panels or units 1-19. According to a not-represented variant, the dividing step S4 and/or the step S5 of providing edge finishing, such as coupling means 21, also can be performed prior to performing the step S1 of printing and/or the step S2 of forming the relief 4.

Preferably, this relates to rectangular and/or square panels or units 1-19. According to a not-represented variant, the dividing step S4 and/or the step S5 of providing edge finishing, such as coupling means 21, also can be performed prior to performing the step S1 of printing and/or the step S2 of forming the relief 4.

FIG. 7 shows an example of a panel 1 or smaller unit 19, which can be obtained according to the invention. Herein, this relates to a floor panel 22 which is provided with an edge finishing at least at two opposite sides or edges 20, in this case coupling means 21 allowing to couple two of such floor panels 22 to each other, and wherein in the obtained coupled condition there is a connection between these floor panels 22 in a horizontal direction H1 in the plane of the floor panels 22 and perpendicular to the coupled sides 20 concerned, as well as in a vertical direction V1 perpendicular to the surface of the floor panels 22. It is noted that such coupling means are known as such from WO 97/47834. Further, the floor panel 22 has chamfers 23 at the same two opposite sides 20. It is clear that these chamfers 23 can form part of the relief 4, which is formed according to the method of the first aspect after the decor 3 already has been printed at least partially on the substrate 2.

FIG. 8 shows that the floor panel 22 of FIG. 7 comprises a synthetic layer 13 provided on the printed decor 3, in this case a lacquer layer. As represented here, the finally obtained top layer 24 shows a structure of recesses composed of, on the one hand, the relief 4 formed by the printed decor 3 and, on the other hand, of recesses 16 and/or protrusions formed in the top layer 24, however, situated at a distance above said printed decor 3. In the present case, the floor panel 22 relates to an imitation of so-called scraped wood, wherein path-shaped recesses 25 for imitating scrape paths are combined with smaller recesses 26 for imitating wood pores. Herein, the path-shaped recesses 25 substantially are formed by the relief 4 of the printed decor 3, whereas said smaller recesses substantially are formed by said recesses 16 situated at a distance above the printed decor 3.

In connection with the FIGS. 1 through 8, it is also noted that the thickness of the different layers of the top layer 24 is represented only schematically and that the mutual differences in thickness are not to be understood as restrictive.

Further, it is also noted that there, where in the preceding text one or more primer layers are mentioned, this relates to layers having an influence on the adherence of the printed decor on the substrate and/or layers which can form a, whether or not neutral, background for the printed decor. According to the invention, it is not excluded that the actual substrate, such as a MDF or HDF board, is provided with one or more layers not having the above-mentioned features of such primer layer. In such case, the substrate according to the invention is seen as the composition of the actual substrate and these layers.

The present invention is in no way limited to the embodiments described by way of example and represented in the figures, on the contrary may such methods and panels be realized according to various variants, without leaving the scope of the invention.

The invention claimed is:

1. A method for manufacturing panels of the type having at least a wood-based substrate and a top layer provided on the substrate, the top layer including a wear-resistant layer and a printed decor with a relief, the method comprising:

using a roller to apply one or more primer layers to a flat surface of the substrate, the one or more primer layers forming a background of a white or uniform color;

printing, by the intermediary of the one or more primer layers, at least one ink layer forming a portion of the decor onto the substrate; and forming the relief in the at least one ink layer using a press element;

wherein the relief is formed at least partially after the portion of the decor has been printed on the substrate;

wherein the relief is only formed after the portion of the decor has been dried in a forced manner by application of at least one of hot air and radiation;

wherein the wear-resistant layer is provided above the at least one ink layer after the at least one ink layer has been provided with the relief;

wherein the wear-resistant layer is free from material sheets; and wherein the wear-resistant layer extends continuously over the entirety of the decor and contacts the at least one ink layer.

2. The method of claim 1, wherein for printing the at least one ink layer, use is made of a digital printing technique.

3. The method of claim 1, wherein for printing the at least one ink layer, use is made of offset printing.

4. The method of claim 1, wherein the relief corresponds at least partially to the at least one ink layer.

5. The method of claim 1, wherein the relief comprises height differences which are larger than the thickness of the at least one ink layer.

6. The method of claim 1, wherein the relief is made with such height differences that the relief continues at least to beneath an initial global level of the at least one ink layer.

7. The method of claim 1, wherein the relief is made with such height differences that the relief continues at least one of into the substrate, and into a layer located between the at least one ink layer and the substrate.

8. The method of claim 1, wherein the method is applied for manufacturing floor panels.

* * * * *